United States Patent [19]

Sugarman

[11] 4,250,431

[45] Feb. 10, 1981

[54] PARTICULATE COLLECTOR APPARATUS AND METHOD FOR ION GENERATORS

[76] Inventor: Joseph Sugarman, 628 Michelline La., Northbrook, Ill. 60062

[21] Appl. No.: 106,923

[22] Filed: Dec. 26, 1979

[51] Int. Cl.[3] ..... H05F 3/02

[52] U.S. Cl. ..... 315/111.9; 250/324; 361/231

[58] Field of Search ..... 315/111.8, 111.9; 313/362; 250/324; 361/226, 229, 230, 231; 55/140

[56] References Cited

U.S. PATENT DOCUMENTS

| | | | |
|---|---|---|---|
| 3,234,432 | 2/1966 | Streib | 361/231 |
| 3,862,420 | 1/1975 | Banks et al. | 250/324 |
| 4,151,577 | 4/1979 | Yavnieli et al. | 361/231 |

FOREIGN PATENT DOCUMENTS

| | | | |
|---|---|---|---|
| 2257214 | 8/1975 | France | 315/111.9 |

*Primary Examiner*—Eugene R. LaRoche
*Attorney, Agent, or Firm*—George H. Gerstman

[57] ABSTRACT

An apparatus and method are described for preventing electrically charged particles adjacent an ion generator from soiling a wall or other items adjacent the ion generator. An electrically conductive particle collector surrounds the outlet of the ion generator and is fastened to the ion generator. The electrically conductive particle collector carries an electrical line which is adapted to be plugged into the ground terminal of an electrical wall socket. A disposable sheet member, preferably formed of paper, covers the particle collector. Electrically charged particles adjacent the ion generator area are attracted to the particle collector and coat the disposable sheet member which can be easily removed and replaced.

4 Claims, 3 Drawing Figures

FIG. 1
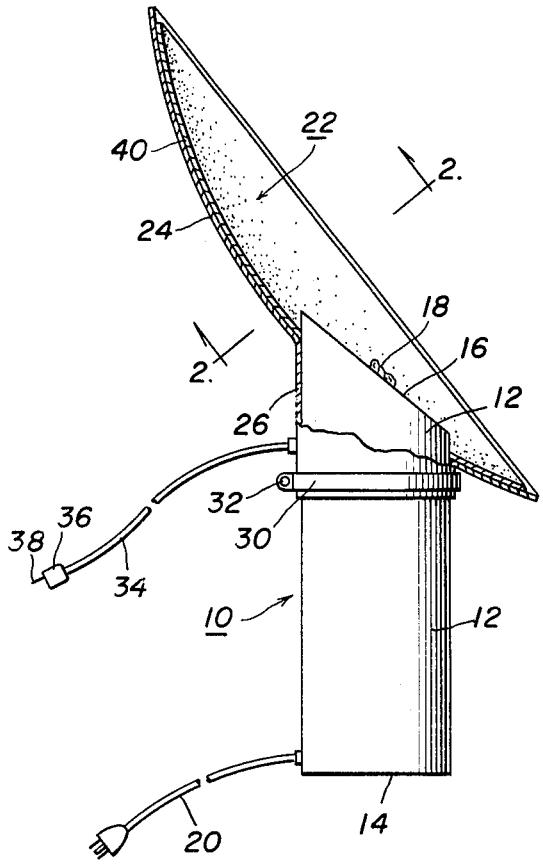
FIG. 2
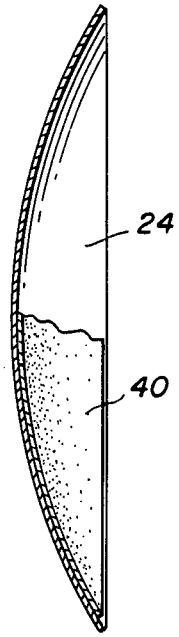
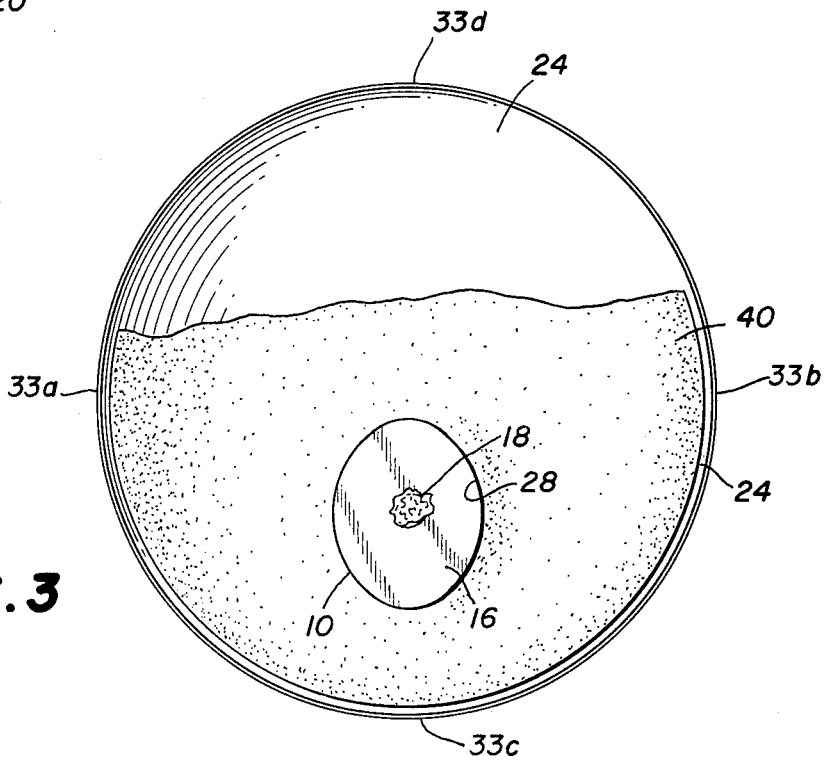
FIG. 3

PARTICULATE COLLECTOR APPARATUS AND METHOD FOR ION GENERATORS

BACKGROUND OF THE INVENTION

The present invention concerns a novel apparatus and method for preventing electrically charged particulate matter adjacent an ion generator from soiling walls and other items adjacent the ion generator.

Ion generators, often referred to as ionized oxygen generators, have recently become very popular. Ionized oxygen has been found to create a substantially germ-free environment, and many hospitals are using ion generators in their operating rooms. Ionized oxygen also eliminates allergy-causing irritants making an ion generator useful for homes and offices, as well as hospitals.

One of the positive functions of the ionized oxygen provided by an ion generator is that the ionized oxygen cleanses the air by attaching itself to particles floating in the air, causing the particles to fall. I have discovered, however, that dark particulate matter in the air adjacent an ion generator becomes electrically charged so that it is attracted to the nearest ground. For example, if the ion generator is placed on a desk near a wall, and the wall is the nearest ground, the particulate matter may become attracted to the wall and darken the wall.

It is, therefore, an object of the the invention to provide an apparatus that is useful to prevent particulate matter adjacent an ion generator from becoming attracted to and darkening a wall, desk or other area which should be maintained clean.

Another object of the present invention is to provide a method for preventing electrically charged particles adjacent an ion generator from soiling a wall adjacent the ion generator.

A further object of the present invention is to provide a particulate collector for connection to an ion generator, which collector is simple in construction and easy to manufacture.

A still further object of the invention is to provide a particulate collector for an ion generator which may be easily attached to an ion generator and used with conventional electrical receptacles.

Other objects and advantages of the present invention will become apparent as the description proceeds.

SUMMARY OF THE INVENTION

In accordance with the present invention, a collector apparatus is provided for connection to an ion generator. The apparatus comprises an electrically conductive particle collector and means for coupling the particle collector to ground. Means are provided for connecting the particle collector to an ion generator. In this manner, electrically charged particles adjacent the ion generator are attracted to the particle collector instead of being attracted to other areas of the room.

In the illustrative embodiment, a disposable sheet member is provided for covering at least a major portion of the electrically conductive particle collector.

In accordance with the method of the present invention, a method is provided for preventing electrically charged particles adjacent an ion generator from soiling a wall adjacent the ion generator. The method comprises the steps of providing an electrically conductive particle collector, connecting the electrically conductive particle collector to the ion generator, and coupling the electrically conductive particle collector to ground.

In this manner, electrically charged particles adjacent the ion generator are attracted to the particle collector instead of to other areas of the room.

In the illustrative embodiment, the method further includes the step of covering at least a portion of the electrically conductive particle collector with a disposable sheet member.

BRIEF DESCRIPTION OF THE DRAWINGS

FIG. 1 is a side elevational view, taken partly in cross-section, of a particulate collector constructed in accordance with the principles of the present invention;

FIG. 2 is a cross-sectional view thereof, with portions broken for clarity, along the plane of the line 2—2 of FIG. 1; and FIG. 3 is a right angle view of a particulate collector constructed in accordance with the principles of the present invention, with a portion of the disposable sheet member broken away for clarity.

DETAILED DESCRIPTION OF THE ILLUSTRATIVE EMBODIMENT

Referring to the drawings, a conventional ion generator 10 is illustrated in FIG. 1. As a specific example, although no limitation is intended, ion generator 10 could comprise the Energaire ionized oxygen generator sold by JS&A Group, Inc. of Northbrook, Ill. Ion generator 10 has a generally cylindrical main body portion 12, a bottom 14 for resting upon a desk or other suitable surface, an outlet top portion 16, a copper mesh emitter 18 and an electrical line 20 for connection to a household electrical receptacle or any other suitable source of electrical current. It is to be understood that the particular ion generator used is not considered to be a part of the present invention.

As stated above, I have discovered that the ions emitted by the ion generator 10 propel themselves throughout a closed space, and attach themselves to particulate matter within that closed space. The particulate matter becomes electrically charged so that it is attracted to the nearest ground. In order to prevent the soiling of walls or other items adjacent the ion generator, an electrically conductive particle collector 22 is provided, comprising a metal base 24, a downwardly extending sleeve 26 and an aperture 28 defined by the base 24 for receiving the main body portion 12 of ion generator 10. Aperture 28 has a substantially identical configuration to the cross-sectional configuration of main body member 12. In this manner, main body member 12 may be inserted into the aperture 28, as illustrated in FIGS. 1 and 2, with a substantially tight fit. The downwardly extending sleeve 28 will surround the top portion of body member 12 and a collar 30 (FIG. 1) is provided for securing the sleeve 26 to the body member 12 with a clamping force utilizing a bolt and nut connection 32.

It is preferred that base 24 be circular in plan construction (see FIG. 3) with a parabolic cross-sectional configuration (see FIGS. 1 and 2). It is also preferred that opening 28 be centrally located with respect to two opposite sides 33*a*, 33*b* of base 24 (see FIG. 3) and that the general center of aperture 28 be located approximately one-third the distance from one point 33*c* on the circumference of the circular base member 24 to the opposite point 33*d* on the circumference.

An electrically conductive line 34 is electrically connected to sleeve 26. Line 34 terminates in an electrical plug 36 which is adapted to be plugged into a conventional household receptacle having a ground terminal, and plug 36 only has the ground plug 38. Base member 24 and sleeve 26 are formed of metal, such as sheet steel or tin, and the base member 24 will become grounded when plug 36 is plugged into the electrical receptacle.

I have discovered that the collector apparatus can be easily cleaned by providing a disposable paper sheet 40 which is configured to overlie the metallic base member 24. Disposable sheet 40 defines an opening having the same dimension as aperture 28, so that the disposable sheet 40 can be placed over ion generator 10. It is understood that disposable sheet 40 could comprise sheet material other than paper, although it is important that the electrically charged particulate matter be suitably attracted to grounded collector 22 and that the disposable sheet material not form a substantial impediment to such attraction.

In the operation of the system, the collector 22 is simply slid over the top 16 of ion generator 10 and the bolt and nut assembly 32 is tightened to clamp sleeve 26 to main body portion 12. A clean piece of sheet material 40 is then placed on base member 24, with the sheet member 40 surrounding the ion generator 10 as illustrated in FIGS. 1 and 3. Plug 36 is plugged into an electrical receptacle having a ground terminal and the collector will become effective to prevent electrically charged particles adjacent the ion generator from being attracted to walls and other items adjacent the ion generator which are intended to be maintained in a clean condition. Once there has been a sufficient accumulation of particulate matter on sheet member 40, sheet member 40 can be simply removed and a clean sheet member may be substituted in its place.

Although an illustrative embodiment of the invention has been shown and described, it is to be understood that various modifications and substitions may be made by those skilled in the art without departing from the novel spirit and scope of the present invention.

What is claimed is:

1. A collector apparatus for connection to an ion generator, which comprises:

an electrically conductive particle collector;

means for coupling said particle collector to ground; and means for connecting said particle collector to an ion generator, whereby electrically charged particles adjacent the ion generator are attracted to said particle collector.

2. A collector apparatus as described in claim 1, including a disposable sheet member for covering at least a major portion of said electrically conductive particle collector.

3. A method for preventing electrically charged particles adjacent an ion generator from soiling a wall or other items adjacent the ion generator, which comprises the steps of:

providing an electrically conductive particle collector;

connecting the electrically conductive particle collector to the ion generator; and coupling the electrically conductive particle collector to ground, whereby electrically charged particles adjacent the ion generator are attracted to the particle collector.

4. A method for preventing electrically charged particles adjacent an ion generator from soiling a wall or other items adjacent the ion generator as described in claim 3, including the step of covering at least a portion of the electrically conductive particle collector with a disposable sheet member.

* * * * *